US008493001B2

(12) United States Patent
Yang et al.

(10) Patent No.: US 8,493,001 B2
(45) Date of Patent: Jul. 23, 2013

(54) CONTROL CIRCUIT AND LIGHT EMITTING DIODE DRIVER AND METHOD USING THEREOF

(75) Inventors: Yung-Hsiang Yang, Hsinchu (TW); Yu-Nan Yen, Zhudong Township, Hsinchu County (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 301 days.

(21) Appl. No.: 13/104,464

(22) Filed: May 10, 2011

(65) Prior Publication Data

US 2011/0285311 A1 Nov. 24, 2011

(30) Foreign Application Priority Data

May 18, 2010 (TW) ..... 99115800 A

(51) Int. Cl.
*H05B 37/02* (2006.01)

(52) U.S. Cl.
USPC ..... 315/307; 315/291

(58) Field of Classification Search
USPC ..... 315/307, 291, 185 R, 192, 209 R, 315/217, 193
See application file for complete search history.

(56) References Cited

U.S. PATENT DOCUMENTS

2010/0013395 A1* 1/2010 Archibald et al. ..... 315/185 R

* cited by examiner

*Primary Examiner* — Daniel D Chang

(57) ABSTRACT

A control circuit applied in a light emitting diode (LED) driver includes a counter, a sample circuit, and a signal source. The counter counts a parameter indicating the duty cycle width of a dimming signal in response to a front edge of the dimming signal. The sample circuit obtains a sample signal by means of sampling the most significant bit (MSB) of the parameter in response to the rear edge of the dimming signal. The duty cycle width is determined to be greater than a threshold value and smaller than that when the sample signal corresponds with a terminal value and an initial value, respectively. The signal source provides a reference voltage corresponding to first level and that corresponding to second level, higher than the first level, to drive a boost converter of the LED driver in response to the terminal value and the initial value, respectively.

9 Claims, 3 Drawing Sheets

CONTROL CIRCUIT AND LIGHT EMITTING DIODE DRIVER AND METHOD USING THEREOF

This application claims the benefit of Taiwan application Serial No. 099115800, filed May 18, 2010, the subject matter of which is incorporated herein by reference.

BACKGROUND OF THE INVENTION

1. Field of the Invention

The invention relates in general to a controller, and more particularly to a controller applied in a light emitting diode (LED) driver.

2. Description of the Related Art

With the technology changes within each passing day, light emitting diode (LED) driver has been developed for enhancing people's living. In a practical case, LED has been applied as backlight source of a flat display. Generally, boost converters are employed in a LED backlight module for providing driving voltages in response to dimming control signals, so as to drive LED modules. For example, the dimming control signals are pulse width modulation (PWM) signals and the boost converters work in the duty cycle of the PWM signals, so as to accordingly provide the driving voltages.

In practical situation, however, the driving voltages provided by the boost converters are unstable due to the short duty cycle of the dimming signals. Thus, the LED modules are also affected and fail to provide light with stable brightness, resulted in flicker of the flat display. Thus, how to provide a LED driver capable of supplying stable driving voltages has become a prominent goal for the industries.

SUMMARY OF THE INVENTION

According to a first aspect of the present invention, a controller applied in a light emitting diode (LED) driver for selectively controlling a level of a reference voltage signal is provided. The LED driver comprises a boost converter for driving a LED circuit according to the reference voltage signal and a dim signal. The controller comprises a counter, a sample circuit, and a source circuit. The counter counts a counting parameter, which indicates a duty cycle length of the dim signal, in response to a front edge of the dim signal. The counting parameter comprises n bits, wherein n is an integer greater than 1. The sample circuit samples a most significant bit (MSB) of the n bits to obtain a first sample signal in response to a rear edge of the dim signal to obtain a first sample signal. When the first sample signal corresponds to an end value, it is indicated that the duty cycle length is greater than or equal to a first threshold. When the first sample signal corresponds to an initial value, it is indicated that the duty cycle length is smaller than the first threshold. The source circuit provides the reference voltage signal corresponding to a first voltage level in response to the end value of the first sample signal and provides the reference signal corresponding to a second voltage level in response to the initial value of the first sample signal. The first voltage level is lower than the second voltage level.

According to a second aspect of the present invention, a LED driver for driving a LED circuit is provided. The LED driver comprises a boost converter, a node, a current regulator and a controller, as depicted in the previous paragraphs. The boost converter is enabled in a duty cycle of a dim signal for output voltage regulation according to a reference voltage signal. The node has a bias voltage signal. The current regulator is serially connected with the LED circuit via the node for determining an operation current flowing through the LED circuit in response to the bias voltage signal.

According to a third aspect of the present invention, a control method applied in a LED driver for managing a level of a reference voltage signal is provided. The LED driver comprises a boost converter for drive a LED circuit according to the reference voltage signal and a dim signal. The control method includes steps depicted in the previous paragraphs.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
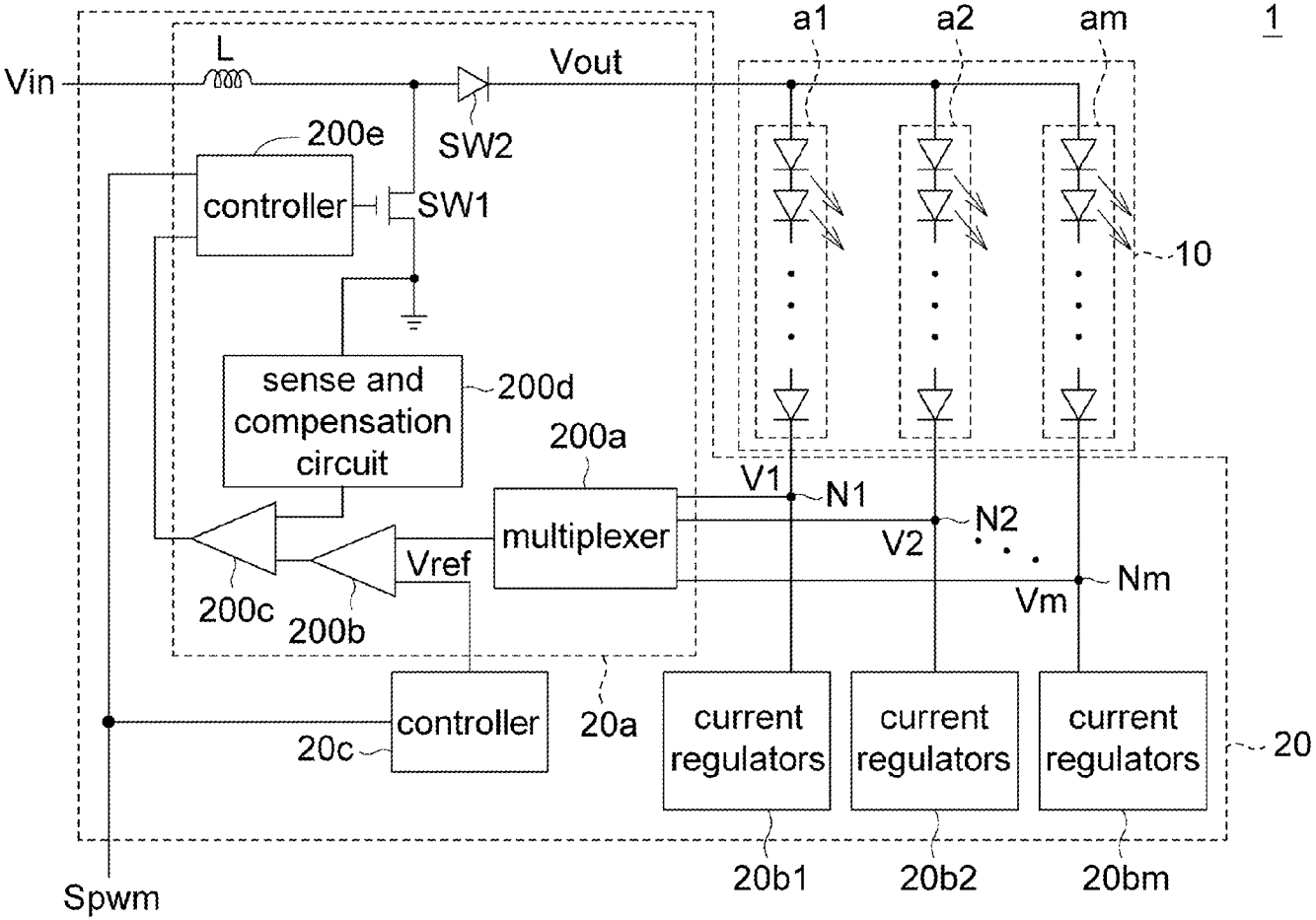
FIG. 1 is a block diagram of a light emitting diode module according to the embodiment.

Referring to FIG. 1, a block diagram of a light emitting diode module according to the embodiment is shown. For example, a light emitting diode (LED) module 1 is employed as a backlight module in a liquid crystal display (LCD). The LED module 1 comprises a LED circuit 10 and a LED driver 20. For example, the LED circuit 10 includes m LED series a1, a2, . . . , am, which are connected in parallel, wherein m is a natural number greater than 1.

The LED driver 20, for driving the LED circuit 10, includes a boost converter 20*a*, nodes N1, N2, . . . , Nm, current regulators 20*b*1, 20*b*2, . . . , 20*bm*, and a controller 20*c*. The boost converter 20*a* is enabled in a duty cycle of a dim signal Spwm for controlling a level of a output voltage signal Vout according to a reference voltage signal Vref. For example, the boost converter 20*a* is a switched-mode power supply (SMPS), including a storage unit L, switches SW1, SW2, and controller 200*e*. With the controller 200*e* driving the switch SW1 and the storage unit L to carry out switch operation and storage operation, the boost converter 20*a* provides the output voltage signal Vout, wherein the output voltage signal Vout has a level higher than that of an input voltage signal Vin. The boost converter 20*a* further includes a multiplexer 200*a*, an amplifier 200*b*, a comparator 200*c*, and a sense and compensation circuit 200*d*. The multiplexer 200*a* is coupled to the nodes N1-Nm for receiving the respective bias voltage signals V1-Vm and for feeding the bias voltage signal, corresponding to a lowest voltage level within the bias voltage signals V1-Vm, back to the controller 200*e* via the amplifier 200*b* and the comparator 200*c*, so as to achieve a negative feedback circuit for output voltage regulation and providing the output voltage signal Vout with stable level.

The nodes N1-Nm are respectively coupled to the LED series a1-am. The nodes N1-Nm correspond to the respective bias voltage signals V1-Vm. For example, each of the bias voltage signals V1-Vm has a voltage level, which is obtained by subtracting a cross voltage across each of the respective LED series a1-am from the output voltage signal Vout provided by the boost converter 20*a*. For example, same amount of LEDs are serially connected to form each of the LED series a1-am, so that the bias voltage signals V1-Vm, for example, correspond to a same voltage level.

Figure 2:
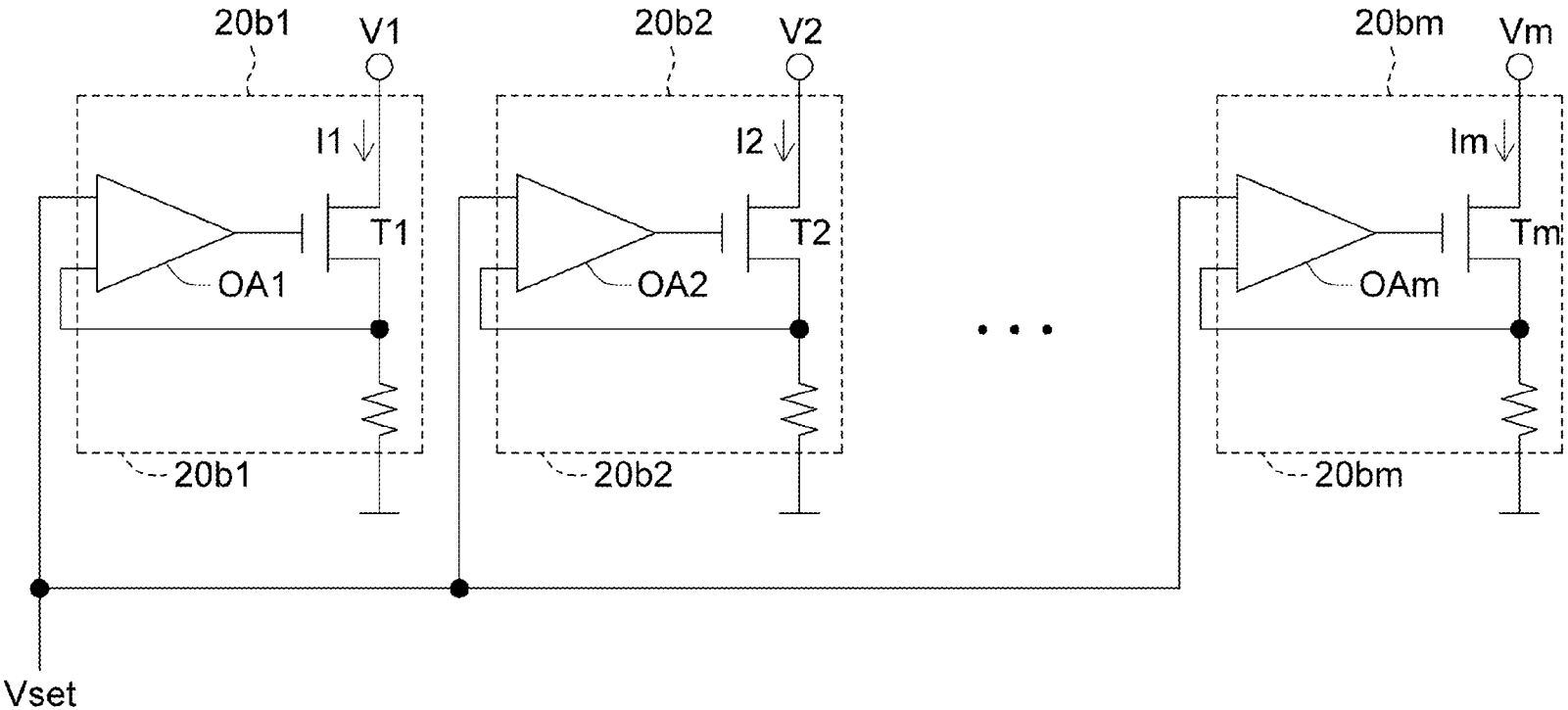
FIG. 2 is a detailed block diagram of the current regulators 20*b*1-20*bm*.

The current regulators 20*b*1-20*bm* are serially connected to the respective LED series a1-am via the respective nodes N1-Nm. The current regulators 20*b*1-20*bm* determine operation currents I1, I2, . . . , Im flowing through the respective LED series a1-am in response to the respective bias voltage signals V1-Vm. In an example, a detailed block diagram of the current regulators 20*b*1-20*bm* is shown in FIG. 2. The current regulators 20*b*1-20*bm* respectively include transistors T1, T2, . . . , Tm and operational amplifiers OA1, OA2, . . . , OAm. The operational amplifiers OA1-OAm bias the sources of the respective transistors T1-Tm to a bias voltage Vset accordingly. For example, the bias voltage Vset is provided by a bias circuit (not shown). In an ideal situation, the voltage difference between the bias voltage V1-Vm and the bias voltage Vset, i.e. the source-drain cross voltages of the respective transistors T1-Tm, are substantially greater than the threshold voltages between the saturation region and the linear region of the respective transistors T1-Tm. Thus, the transistors T1-Tm operated in the saturation region can have the operation currents I1-Im flowing through the respective LED series a1-am stable and substantially equal to one another, so as to drive the LED circuit 10 providing uniform and stable backlight.

However, the boost converter 20*a* is enabled for driving the output voltage signal Vout in the duty cycle of the dim signal Spwm. Thus, the boost converter 20*a* may fail to keep the output voltage signal Vout in stable in a situation that the duty cycle of the dim signal Spwm is shorter than the response time of the boost converter 20*a*. That will result in a situation that the bias voltage signals V1-Vm have unstable voltage levels, the transistors T1-Tm within the current regulators 20*b*1-20*bm* cannot be guaranteed to operate in the saturation region, the operation currents I1-Im are unstable, and the light provided by the LED current 10 is unstable. In a practical example, the duty cycle of the dim signal Spwm corresponds to an 8 microseconds lower threshold, in other words, when the duty cycle of the dim signal Spwm is smaller than 8 microseconds, the output voltage signal Vout will be very likely to be unstable.

The controller 20*c* selectively switches the level of the reference voltage signal Vref to selectively enhance the drivability of the boost converter 20*a*, so that the magnitudes of the currents provided by each of the current regulators 20*b*1-20*bm*, i.e. the currents flowing through each of the LED series a1-am are managed and the situation that the LED series a1-am provide unstable light is accordingly avoided. Thus, when the duty cycle of the dim signal Spwm is smaller than the lower threshold, the drivability of the boost converter 20*a* is accordingly enhanced, so as to avoid the undesired situation. Besides, the controller 20*c* according to the present embodiment can further selectively reduce the drivability of the boost converter 20*a* by means of reducing the level of the reference voltage signal Vref when the duty cycle of the dim signal Spwm is greater than or equal to a upper threshold, such that the power consumption of the boost converter 20*a* can reduced and have the LED driver 20 according to the present embodiment more power efficient. For example, the upper threshold of the duty cycle of the dim signal Spwm is 15 microseconds.

Figure 3:
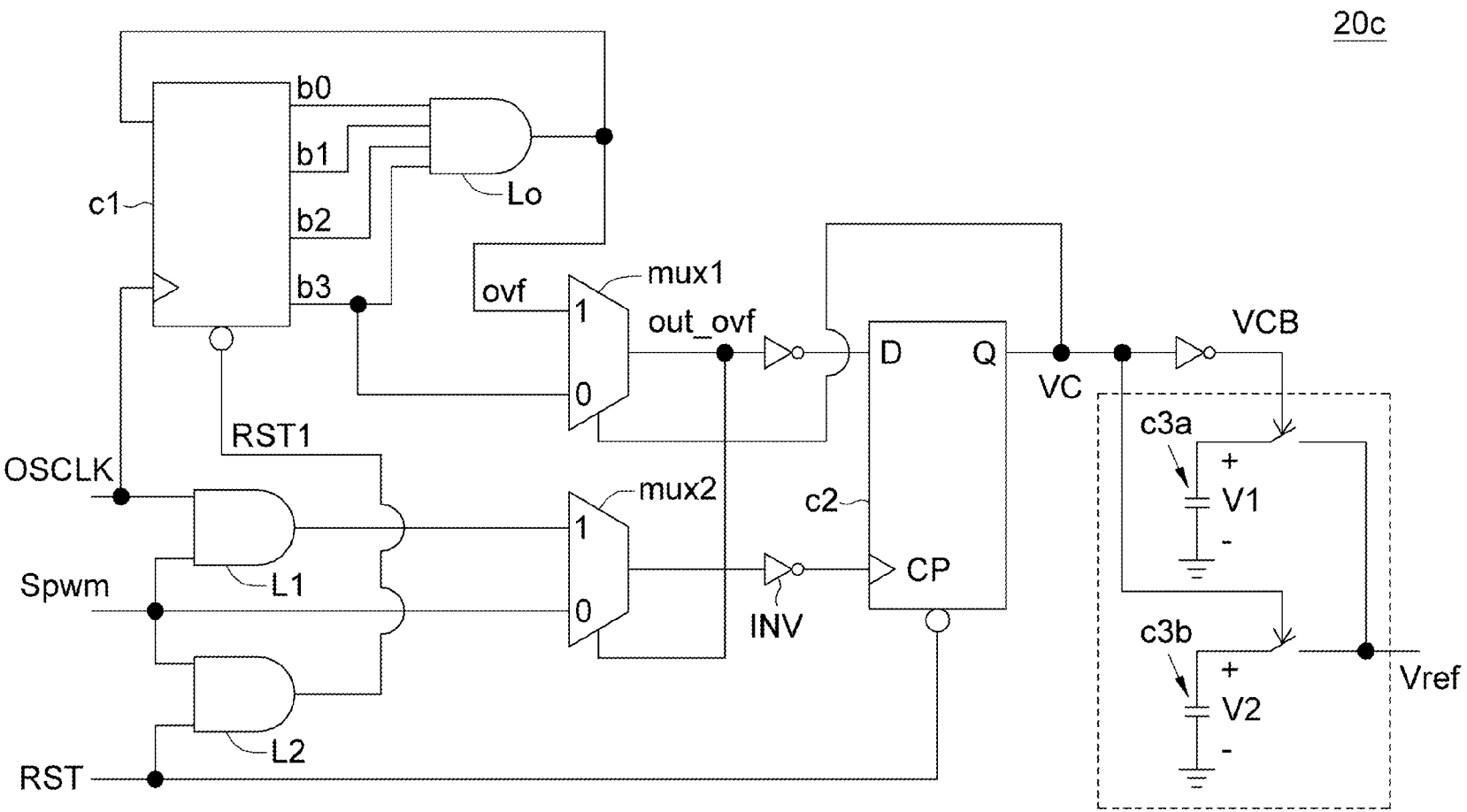
FIG. 3 is a detailed block diagram of the controller 20*c* of FIG. 1.

Referring to FIG. 3, a detailed block diagram of the controller 20*c* of FIG. 1 is shown. In an example, the controller 20*c* includes a counter c1, a sample circuit c2, and a source circuit c3. The counter c1 counts a counting parameter, which indicates the length of the duty cycle of the dim signal Spwm, in response to a front edge of the dim signal Spwm, wherein the counting parameter includes n bits and n is a natural number greater than 1. In an example, n=4, the counting parameter includes bits b0, b1, b2, and b3.

Furthermore, the counter c1 includes a reset pin, a clock pin, and four output pins. The counter c1 resets the counting parameter to 0 in response to a reset signal RST1 received via the reset pin, has the counting parameter incremented by 1 in response to a front edge (e.g. a rising edge) of a clock signal OSCLK received via the clock pin, and outputs the bits b0-b3 via the four output pins. For example, the reset signal RST1, which has its rising edge triggered at substantially the same time as that of the dim signal Spwm, is provided by a logic circuit L2. Thus, under the control of the reset signal RST, the counter c1 can have the counting parameter incremented by 1 in response to the rising edge of the dim signal Spwm after the time point that the rising edge of the dim signal Spwm is triggered. For example, the logic circuit L2 is a logic AND and the period of the clock signal OSCLK is 1 microsecond.

The sample circuit c2 includes a reset pin and a clock pin. The sample circuit c2 resets a sample signal VC to value 0 in response to the reset signal RST received via the reset pin and receives an inversed dim signal via the clock pin, so as to obtain a sample signal VC by means of sampling an inversed signal of the most significant bit (MSB) within the bits b0-b3 (i.e. the inversed signal of the bit b3) in response to a rising edge the inversed dim signal (i.e. the rear edge of the dim signal Spwm). The sample signal VC indicates that whether the counting parameter is greater than or equal to 8 (i.e. $(1000)_2$) after the duty cycle of the dim signal Spwm ends, in other words, the sample signal VC indicates whether the length of the duty cycle of the dim signal Spwm is substantially greater than or equal to 8 cycle lengths of the clock signal OSCLK or the lower threshold 8 microseconds.

When the sample signal VC corresponds to an end value of 0 (i.e. the bit b3 indicates value 1), it is indicated that the duty cycle of the dim signal Spwm is longer than or equal to the lower threshold 8 microseconds and the boost converter 20*a* has sufficient drivability, so that the currents provided by each of the current regulators 20*b*1-20*bm* (i.e. the currents flowing through the respective LED series a1-am) and the brightness of the LED series a1-am are not apt to be unstable. When the sample signal VC corresponds to an initial value of 1 (i.e. the bit b3 indicates value 0), it is indicated that the duty cycle of the dim signal Spwm is shorter than the lower threshold 8 microseconds, so that the boost converter 20*a* is apt to have insufficient drivability, the currents provided by each of the current regulators 20*b*1-20*bm* and the brightness of the LED series a1-am are apt to be unstable.

The source circuit c3 includes voltage sources c3*a* and c3*b*. The source circuit c3 provides the reference voltage Vref corresponding to a voltage level v2 in response to the sample signal VC with an initial value 1 and a sample signal VCB (i.e. an inversed signal of the sample signal VC) with an end value 0; and provides the reference voltage Vref corresponding to a voltage level v1 in response to the sample signal VC with the end value 0 and the sample signal VCB with the initial value 1. Thus, the controller 20*c* is capable of selectively providing the reference voltage signal Vref corresponding to the voltage level v2 to drive the boost converter 20*a* when the duty cycle of the dim signal Spwm is shorter than the lower threshold 8 microseconds.

In an example, the controller 20*c* further includes a logic circuit L0 and a multiplexer mux1. The logic circuit L0 executes AND operation on the bits b0-b3 to accordingly obtain a control signal ovf. The multiplexer mux1 is coupled to the sample circuit c2 for receiving the control signal ovf and the MSB b3. The multiplexer mux1 provides the MSB b3 to the sample circuit c2 in response to an end value 0 of the sample signal VC and provides the control signal ovf to the sample circuit c2 in response to an initial value 1 of the sample signal VC. In an initial state, the rising edge of the reset signal RST is triggered before the rising edge of the dim signal Spwm and the sample signal VC is rest as value 0, so that the multiplexer mux1 accordingly provides the MSB b3 to the sample circuit c2 for sampling operation.

In an example, the sample signal VC is set as the initial value 1 in previous operations (due to the duty cycle of the dim signal Spwm is shorter than the lower threshold 8 microseconds), and the controller 20*c* accordingly provides the reference voltage Vref corresponding to the voltage level v2 to drive the boost converter 20*a*. Thus, the multiplexer mux1 accordingly provides the control signal ovf to the sample circuit c2 for sampling operation. Similar to the operation that the sample circuit c2 has the inversed signal of the MSB b3 sampled to obtain the sample signal VC described previously, in the situation that the sample signal VC corresponding to the initial value 1, the sample circuit c2 executes sampling operation on the inversed signal of the control signal ovf to obtain a next sample signal, which indicates whether the counting parameter is substantially greater than 15 (i.e. the value $(1111)_2$) after the duty cycle of the dim signal Spwm ends, in other words, the next sample signal indicates whether the length of duty cycle of the dim signal Spwm is substantially longer than or equal to 15 cycle lengths of the clock signal OSCLK or the upper threshold 15 microseconds.

When the sample signal VC corresponds to the end value 0, i.e. the bits b0-b3 all indicate value 1, it is indicated that the length of the duty cycle of the dim signal Spwm is longer than or equal to the upper threshold 15 microseconds, in other words, the length of the duty cycle of the dim signal Spwm is greater than the lower threshold 8 microseconds. Thus, the source circuit c3 provides the reference voltage signal Vref corresponding to the voltage level v1 in response to the sample signals VC and VCB respectively with value 0 and 1. In other words, when length of the duty cycle of the dim signal Spwm is longer than or equal to the upper threshold 15 microseconds and is greater than the lower threshold 8 microseconds, the controller 20*c* switches the level of the reference voltage signal Vref from the voltage level v2 to the voltage level v1, so as to reduce the overall power consumption of the LED driver 20.

When the sample signal VC corresponds to the initial value 1, i.e. at least one among the bits b0-b3 does not indicate value 1, it is indicated that length of the duty cycle of the dim signal Spwm is smaller than the upper threshold 15 microseconds. Thus, the source circuit c3 keeps the reference voltage signal Vref corresponding to the voltage level v2, i.e. keeps the reference voltage signal Vref has higher voltage level, in response to the sample signals VC and VCB respectively with values 1 and 0. In other words, when length of the duty cycle of the dim signal Spwm is shorter than the upper threshold 15 microseconds, the controller 20*c* keeps providing the reference voltage signal Vref corresponding to the voltage level v2, so as not to switch the level of the reference voltage signal Vref from the voltage level v2 to the voltage v1 before the duty cycle of the dim signal Spwm is constantly over the upper threshold 15 microseconds. In general, noise interference often occurs in embodied circuit and that accordingly results in unstable voltage level in the embodied circuit. By employing the scheme with lower threshold and upper threshold for the duty cycle of the dim signal Spwm, the controller 20*c* according to the present embodiment can effectively avoid itself from switching the level of the reference voltage signal Vref too sensitively, so as to reduce the influence caused by the noise interference on the controller 20*c*.

In an example, the controller 20*c* according to the present embodiment further includes logic circuit L1 and multiplexer mux2. The logic circuit L1 carries out AND operation on the dim signal Spwm and the clock signal OSCLK to obtain a shaded clock signal, wherein the shaded clock signal is enabled in the duty cycle of the dim signal Spwm and disabled outside of the duty cycle of the dim signal.

The multiplexer mux2 selectively employs the dim signal Spwm and the shaded clock signal as a sample control signal controlling the sampling operation of the sample circuit c2. When the output signal provided by the multiplexer mux1 corresponds to value 0, an inverted dim signal is provided to the sample signal c2 by an inverter INV, so that the sample circuit c2 executes the sampling operation according to the falling edge (e.g. rear edge) of the inverted dim signal, as illustrated in the present embodiment.

When the output signal provided by the multiplexer mux1 corresponds to value 1, an inverted and shaded clock signal is provided to the sample circuit c2 by the inverter INV for driving the sample circuit c2 executing the sampling operation. That is, the sample circuit c2 can selectively execute the sampling operation according to the inverted and shaded clock signal before the duty cycle of the dim signal Spwm ends via the switch operation of the multiplexer mux2, so as to enhance the operation speed of the controller 20*c* to provide the sample signals VC and VCB.

The controller according to the present embodiment is applied in a LED driver. The controller according to the present embodiment employs a counter, a multiplexer, a sample circuit and a source circuit wherein the counter is for calculating the length of the duty cycle of the dim signal corresponding to the LED driver; the multiplexer is for determining a lower and an upper thresholds according to a MSB of a multiple-bits parameter and a control signal obtained by executing AND operation on the multiple-bits parameter; a sample circuit and a source circuit are for selectively switching a reference voltage of the LED driver from a lower level to a higher level or the other way around. Thus, in comparison to the conventional LED driver, the controller and the LED driver using it according to the present embodiment are advantageously capable of adjusting the level of the reference voltage of the LED driver when the duty cycle of the dim control signal is lower than the lower threshold or higher than the upper threshold and able to provide stable driving voltage for driving the LED module producing stable light.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A controller applied in a light emitting diode (LED) driver for selectively controlling a level of a reference voltage signal, the LED driver comprising a boost converter for driving a LED circuit according to the reference voltage signal and a dim signal, the controller comprising:

a counter counting a counting parameter, which indicates a duty cycle length of the dim signal, in response to a front edge of the dim signal, the counting parameter comprising n bits, wherein n is an integer greater than 1;

a sample circuit, sampling a most significant bit (MSB) of the n bits to obtain a first sample signal in response to a rear edge of the dim signal to obtain a first sample signal, wherein when the first sample signal corresponds to an end value, it is indicated that the duty cycle length is greater than or equal to a first threshold, and when the first sample signal corresponds to an initial value, it is indicated that the duty cycle length is smaller than the first threshold; and a source circuit, providing the reference voltage signal corresponding to a first voltage level in response to the end value of the first sample signal and providing the reference signal corresponding to a second voltage level in response to the initial value of the first sample signal, wherein, the first voltage level is lower than the second voltage level.

2. The controller according to claim 1, further comprising:

a logic circuit, executing AND operation on the n bits to obtain a control signal; and a first multiplexer, receiving the control signal and the MSB and coupled to the sample circuit, the first multiplexer providing the MSB to the sample circuit in response to the end value of the first sample signal and providing the control signal to the sample circuit in response to the initial value of the first sample signal.

3. The controller according to claim 2, wherein the sample circuit further executes sampling operation on the control signal to obtain a second sample signal in response to the rear edge of the dim signal, wherein when the second sample signal corresponds an end value, it is indicated that the duty cycle length is greater than or equal to a second threshold and the source circuit provides the reference voltage signal corresponding to the first voltage level in response to the end value of the second sample signal.

4. The controller according to claim 2, wherein the sample circuit further executes sampling operation on the control signal to obtain a second sample signal in response to the rear edge of the dim signal, wherein when the second sample signal corresponds an initial value, it is indicated that the duty cycle length is smaller than the second threshold and the source circuit provides the reference voltage signal corresponding to the second voltage level in response to the initial value of the second sample signal.

5. The controller according to claim 1, further comprising:

a logic circuit, executing AND operation on the dim signal and a reset signal to obtain a shaded reset signal, the counter resetting the counting parameter to an initial value in response to the shaded reset signal, wherein, the sample circuit resets the first sample signal in response to the reset signal, so as have the first sample signal corresponding to the end value.

6. A light emitting diode (LED) driver, for driving a LED circuit, comprising:

a boost converter, enabled in a duty cycle of a dim signal for managing a level of an output voltage signal according to a reference voltage signal;

a node, having a bias voltage signal;

a current regulator, serially connected with the LED circuit via the node for determining an operation current flowing through the LED circuit in response to the bias voltage signal; and a controller, managing a level of the reference voltage signal, comprising:

a counter counting a counting parameter, which indicates a duty cycle length of the dim signal, in response to a front edge of the dim signal, the counting parameter comprising n bits, wherein n is an integer greater than 1;

a sample circuit, sampling a most significant bit (MSB) of the n bits to obtain a first sample signal in response to a rear edge of the dim signal to obtain a first sample signal, wherein when the first sample signal corresponds to an end value, it is indicated that the duty cycle length is greater than or equal to a first threshold, and when the first sample signal corresponds to an initial value, it is indicated that the duty cycle length is smaller than the first threshold; and a source circuit, providing the reference voltage signal corresponding to a first voltage level in response to the end value of the first sample signal and providing the reference signal corresponding to a second voltage level in response to the initial value of the first sample signal, wherein, the first voltage level is lower than the second voltage level.

7. A control method applied in a light emitting diode (LED) driver for managing a level of a reference voltage signal, the LED driver comprising a boost converter for drive a LED circuit according to the reference voltage signal and a dim signal, the control method comprising:

counting a counting parameter, which indicates a duty cycle length of the dim signal, in response to a front edge of the dim signal, the counting parameter comprising n bits, wherein n is an integer greater than 1;

sampling a most significant bit (MSB) of the n bits to obtain a first sample signal in response to a rear edge of the dim signal to obtain a first sample signal;

when the first sample signal corresponds to an end value, determining that the duty cycle length is greater than or equal to a first threshold and providing the reference voltage signal corresponding to a first voltage level in response to the end value of the first sample signal; and when the first sample signal corresponds to an initial value, determining that the duty cycle length is smaller than the first threshold and providing the reference signal corresponding to a second voltage level in response to the initial value of the first sample signal.

8. The control method according to claim 7, further comprising:

executing AND operation on the n bits to obtain a control signal;

executing sampling operation on the MSB in response to the end value of the first sample signal; and executing sampling operation on the control signal in response to the initial value of the first sample signal.

9. The control method according to claim 8, further comprising:

executing sampling operation on the control signal to obtain a second sample signal in response to the rear edge of the dim signal;

when the second sample signal corresponds an end value, determining that the duty cycle length is greater than or equal to a second threshold and providing the reference voltage signal corresponding to the first voltage level in response to the end value of the second sample signal; and when the second sample signal corresponds an initial value, determining that the duty cycle length is smaller than the second threshold and providing the reference voltage signal corresponding to the second voltage level in response to the initial value of the second sample signal.

* * * * *